United States Patent [19]

Shiozaki et al.

[11] 4,204,891

[45] May 27, 1980

[54] METHOD FOR PREVENTING THE EDGE CRACK IN A GRAIN ORIENTED SILICON STEEL SHEET PRODUCED FROM A CONTINUOUSLY CAST STEEL SLAB

[75] Inventors: Morio Shiozaki; Masafumi Okamoto; Kiyoshi Tanaka; Takahide Shimazu, all of Himeji, Japan

[73] Assignee: Nippon Steel Corporation, Tokyo, Japan

[21] Appl. No.: 965,241

[22] Filed: Nov. 27, 1978

[51] Int. Cl.[2] ..... H01F 1/04

[52] U.S. Cl. ..... 148/111; 148/120

[58] Field of Search ..... 148/111, 112, 120

[56] References Cited

U.S. PATENT DOCUMENTS

| | | | |
|---|---|---|---|
| 3,764,406 | 10/1973 | Littmann | 148/111 |
| 3,895,974 | 7/1975 | Watanabe et al. | 148/112 |
| 4,108,694 | 8/1978 | Shiozaki et al. | 148/111 |

*Primary Examiner*—L. Dewayne Rutledge
*Assistant Examiner*—John P. Sheehan
*Attorney, Agent, or Firm*—Wenderoth, Lind & Ponack

[57] ABSTRACT

A method for preventing edge cracks in a grain oriented silicon steel sheet produced from a continuously cast slab containing 2.5 to 4.0% silicon. This method is carried out with a controlled reduction rate in a rough rolling mill and/or with an adjusted reduction by a pair of edge rolls of an edger.

3 Claims, 1 Drawing Figure

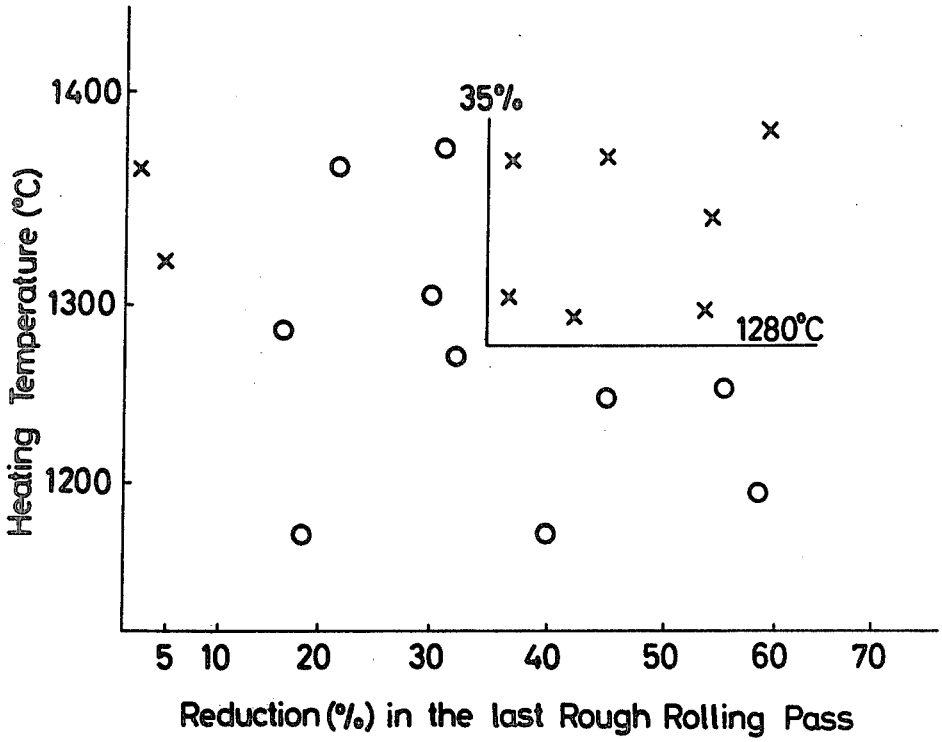
1400
1300
1200
Heating Temperature (°C)
35%
1280°C
5
10
20
30
40
50
60
70
Reduction (%) in the last Rough Rolling Pass

METHOD FOR PREVENTING THE EDGE CRACK IN A GRAIN ORIENTED SILICON STEEL SHEET PRODUCED FROM A CONTINUOUSLY CAST STEEL SLAB

BACKGROUND OF THE INVENTION

The present invention relates to a method for preventing edge cracks or rough edges in a grain oriented silicon steel sheet produced from a continuously cast slab containing 2.5 to 4.0% silicon, particularly edge cracks or rough edges which are caused during hot rolling of the grain oriented silicon steel sheet for a purpose of increasing the production yield.

Rough edges are defined in the present invention as edge cracks caused during the hot rolling step and these edge cracks are direct causes of coil fractures in the subsequent cold rolling step.

A conventional way for overcoming these defects comprises preventing over-cooling of both edges of the sheet or controlling the tension given to the sheet, both being carried out in the finish hot rolling step.

However, these defects are not found in the ingot casting process, but are quite often caused in the continuous casting process.

Therefore, coil edges having edge cracks must be slit off by a slitter before the cold rolling step, so that the production yield is extremely lowered.

Continuously cast materials containing high silicon contents particularly suffer from sever edge cracks when hot rolled into coils because of their cast structure which is produced in the casting. These edge cracks sometimes extend 200 mm from the coil edges.

The biggest problem of the hot coil which is produced by the continuous casting process is the lowering of production yield caused by slitting rough edge parts. However, no successful measures have been made to overcome these defects in the rolling step.

It is well-known in this field that the grain oriented silicon steel sheet for a transformer contains from 2.5% to 4.0% silicon and also contains at least one or more impurities such as Mn, S, Al, N, Sb, B, Se, Cu for forming a precipitated dispersion phase (hereinafter called inhibitors). These inhibitors are necessary for the secondary recrystallization which contributes to improve the magnetic properties.

In order to dissolve these inhibitors completely in the steel, the slab is generally heated at a high temperature not lower than 1250° C. This slab heating temperature is different depending on the contents of these inhibitors. On the contrary, as a general trend, the higher the slab heating temperature is, the more the edge crack in the hot coil increases.

Therefore, in order to overcome the above described defects, the present inventors studied causes of the edge cracks. We found that these edge cracks are influenced by the pass schedule in the hot rolling step, particularly the reduction rate at the last half stage in rough rolling passes, more particularly in the last one or two rough rolling passes before the hot finishing rolling.

SUMMARY OF THE INVENTION

The present invention is based on the above discovery. A main object of the present invention is to provide a new hot rolling process which is carried out by controlling the reduction rate at the last half passes in the rough rolling step between 5% and 35% for producing a grain oriented silicon steel sheet free from the edge cracks in the hot coil.

Another object of the present invention is to provide a method for adjusting the reduction by the edger during the rough rolling in addition to the above described manner.

BRIEF EXPLANATION OF THE DRAWING

The attached FIGURE shows the influence on the occurrence of edge cracks by the slab heating temperature and the reduction rate at the pass schedule in the rough rolling.

DETAILED DESCRIPTION OF THE INVENTION

The steel composition utilized in the present invention comprise 0.025 to 0.085% carbon, 2.5 to 4.0% silicon and appropriate amounts of two or more elements such as Mn, S, Al, Nb, Sb, B, Se and Cu, which act as the inhibitors with the balance being iron and unavoidable impurities.

The carbon content is limited to the range of from 0.025 to 0.085% because carbon contents lower than the range increase the amount of oxide inclusions in the steel and cause deterioration of the iron loss property with an unstable secondary recrystallized texture, and on the other hand, carbon contents beyond the range elongate the annealing time during the decarburization annealing step, thus lowering the production yield on a commercial scale.

The silicon content is limited to the range of from 2.5 to 4.0% because the present invention is directed to a high grade grain oriented silicon steel sheet, and because silicon contents lower than the range can not provide satisfactory magnetic properties such as iron loss, and on the other hand, silicon contents beyond the range cause the coil fractures during the cold rolling.

One or more inhibitors which are necessary for the secondary recrystallization are freely selected from Mn, S, Al, N, Sb, B, Se and Cu according to the required qualities of final products.

For production of the steel slab, the molten steel which contains the above described elements may be continuously cast by any conventional continuous casting method.

An electromagnetic stirring may be applied to an unsolidified molten steel at the secondary cooling stage in the continuous casting process for improving the internal properties of the continuously cast slab. Then the thus-obtained slab is sheared to a predetermined length, and subjected to the slab heating step in a slab reheating furnace. The slab may be pre-rolled before the shearing and slab heating steps. The slab heating step before the hot rolling is carried out to dissolve the inhibitors into solid solution in the steel completely.

Contrary to the conventional process in which the slab heating is carried out at a temperature between 1250° C. and 1430° C. for a predetermined period of time, in the present invention, the slab heating must be done at a temperature in a range of from 1280° C. to 1430° C.

The lower limit of the slab heating temperature is determined by the correlation with the occurrence of edge cracks as shown in the attached FIGURE.

The FIGURE shows the influences on the occurrence of edge cracks by the slab heating temperature and the reduction rate at the last half stage in the rough rolling. In the FIGURE, the mark "O" means a normal edge shape representing the edge cracks are less than 10 mm in length from the edge portion in every part of the coil, and the mark "X" means an abnormal shape representing the edge cracks are more than 10 mm in length.

It can be seen in the FIGURE that the abnormal edge cracks never occur in the hot coil when the slab heating temperature is not higher than 1280° C. As already described, the slab heating for producing a grain oriented silicon steel is normally done at a high temperature not lower than 1250° C., even though the slab heating temperature within this range causes no abnormal edge cracks as far as the slab heating temperature not higher than 1280° C., because when the slab heating temperature is not higher than 1280° C., an abnormal grain growth connected to the crack at grain boundaries can not be seen in the slab heating step. Therefore, the lower limit of the slab heating temperature is 1280° C. from the above reason. On the other hand, the upper limit is determined from the point of the capability of the furnace to withstand damages due to high temperatures.

The heated slab is extracted from the slab reheating furnace and then hot rolled. The present invention is carried out in this hot rolling step, particularly in the rough rolling step. In this rough rolling step, the reduction rate at the last half passes, particularly at the last one or two passes is controlled between 5% and 35% to prevent the edge cracks, and then the finish hot rolling is done at a temperature not lower than 1050° C. (hereinafter called the starting temperature of the finish hot rolling) by a continuous hot finishing rolling mills.

The thus-obtained hot rolled coil having a thickness of 1.5 to 5.0 mm is annealed, if necessary. This annealing is normally done at a temperature in the range of from 650° C. to 1200° C.

Then the hot rolled coil is cold rolled to a desired thickness by an ordinary one-step cold rolling method or by a two-step cold rolling method involving an intermediate annealing.

The cold rolled strip thus obtained is subjected to decarburization annealing and further to secondary recrystallization annealing within a temperature range of from 950° C. to 1250° C.

The pass schedule of rough rolling in the hot rolling step which is an essential feature in the present invention will be described below in detail.

The heated slab which is still at the high temperature is generally rough rolled into a predetermined thickness by a reversing rough rolling mill or continuous rough rolling mills after scale removal with a small reduction rate by a scale-breaker.

The reversing or continuous rough rolling mills has a pair of vertical edge rolls of an edger to reform the width of the slab therebetween during the rough rolling. The reduction rate of the heated slab in the rough rolling mill is determined depending on the capacity of a crop-shear and hot finishing rolling mills. In the present invention, the heated slab is rough rolled into a thickness of from 15 to 60 mm.

However, the conventional rough rolling operation, which is designed to distribute an equal load on each pass, can not be applied to the heated slab at the high temperature produced by the continuous casting process, because, when the continuously cast slab having a cast structure is heated at a high temperature, the cast structure develops abnormal coarse grains.

While the thus-heated slab having coarse grains is rough rolled by a conventional way as above described, edge cracks occur in both edges of the finish hot rolled coil which is produced by subjecting the rough rolled coil to finish hot rolling at a starting temperature not lower than 1000° C. in the finish hot rolling mills.

The present inventors made extensive studies and found a close connection of the slab heating temperature and the reduction rate in each pass schedule in the rough rolling with the occurrence of edge cracks. The present inventors also confirmed that the abnormal edge cracks never occur when the starting temperature of the finish hot rolling is not higher than 1000° C., because the metallurgical structure in the edge portion is finely recrystallized by the rolling strain before the rough rolling finishes. While the starting temperature of finish hot rolling is lower than 1050° C., incomplete secondary recrystallization develops in the final products, so that this starting temperature must be kept not lower than 1050° C. for obtaining the desired magnetic properties.

It is also shown in the FIGURE that no abnormal edge cracks in the hot coil occur if the reduction rate at later passes, particularly in the last one or two passes is within the range of 5 to 35% even when the slab heating temperature is higher than 1280° C. This means that a heavy reduction rate may be applied at the first half stage in the rough rolling while the slab to be rolled is at high temperatures, and a relatively small reduction rate may be applied at the last half stage, particularly at the last one or two passes.

This also means that a relatively small reduction rate may be applied in each pass by increasing the number of passes in the rough rolling, so that in the later stage in the rough rolling, the reduction rate may be small.

Although further studies are still to be made to clarify correctly the reasons why the defects, such as edge cracks in the hot coil, are eliminated by the specific pass schedule in the rough rolling, the present inventors assumed the following reasons based on many experiments and investigations. The cast structure in the surface portion is extremely grown up when the continuously cast slab is heated to a temperature higher than 1280° C.

And when the coarse grains (about 7–30 mm) in the edge portion are not finely recrystallized before the finish hot rolling, the abnormal edge cracks occur in the hot coil. On the contrary, when the coarse grains in the edge portion are finely recrystallized, no abnormal edge cracks can be seen in any portions of the hot coil. Further studies were done on the steel structure. The structure in the slab edge portion immediately after the heating is unchanged and maintains the coarse grain in the first half stage of the rough rolling when the starting temperature of the hot finish rolling is not lower than 1000° C.

Results of experiments made by changing the reduction rate in each pass in the rough rolling revealed the following facts. When a small reduction rate in the range of 5 to 35% is applied at the last half stage, particularly at the last one or two passes, in the rough rolling, the structure in the edge portion after the rough rolling is already refined into fine recrystallized grains less than 3 mm and also the cracks at grain boundaries are markedly suppressed. As a result of this rolling operation, the edge cracks are extremely decreased. Meanwhile, a reduction rate more than 35% produces only incomplete recrystallization, and on the other hand, a reduction rate less than 5% causes coarse grains, both failing to produce satisfactory results. Therefore, in respect to the mechanism of the occurrence concerning edge cracks in the hot coil produced by the continuous casting process the following factors are considered: the development of coarse grains of cast structure in the edge portion of the slab; the cracking at the grain boundaries in the edge portion in the step of rough rolling; and the propagation of cracks in the finish hot rolling. The most effective way to prevent the edge cracks is to refine the edge structure at a temperature not lower than 1050° C. before the hot finish rolling step so as to completely prevent the cracks at grain boundaries, particularly to recrystallize coarse grains in the edge portion into fine-grains by applying a proper strain of reduction (reduction rate in the range of 5 to 35%) in the last half passes of the rough rolling where the temperature of the central portion of the material is lowered.

When the starting temperature of the finish hot rolling is 1000° C. or lower, coarse grains begin to recrystallize at the first half stage of the rough rolling because the rolling temperature is lowered from the first half stage. Therefore, no edge cracks occur in the hot coil without applying the small reduction in the later stage in the rough rolling.

However, if the starting temperature of the hot finish rolling is not higher than 1050° C., the resultant magnetic properties are extremely unstable. The present inventors made further studies for eliminating the edge cracks from a different aspect.

As a result of these studies, it has been discovered that when the reduction rate by vertical rolls of an edger is adjusted, the abnormal edge crack can further be decreased.

Conventional use of an edger is aimed to obtain a hot coil having less width fluctuation by employing the edger intentionally in the rough rolling step.

On the contrary, in the present invention the reduction rate of the edger is minimized without causing deterioration of the width fluctuation, thereby an excellent edge shape which is less than 5 mm can be obtained.

DESCRIPTION OF PREFERRED EMBODIMENTS

EXAMPLE 1

A molten steel containing 0.041% carbon, 3.0% silicon, 0.09% manganese, 0.020% sulphur, 0.015% aluminum, 0.005% nitrogen and balance being iron and unavoidable impurities was continuously cast into slabs having a thickness of 250 mm and a length of 1000 mm. After these slabs were heated at 1340° C., the heated slabs were rough rolled applying the reduction rates shown in Table 1, and maintaining a temperature not lower than 1050° C. before the hot finish rolling, into a thickness of 2.3 mm and a width of 980 mm. The distance of between the vertical rolls of the edger was 990 mm.

The thus-obtained hot coils were slitted off the edge portions which were susceptible to edge cracks, then annealed at 1050° C. and subjected to cold rolling, decarburization annealing at 850° C. and final high temperature annealing at 1200° C. The resultant products showed excellent magnetic properties, such as $B_{10} > 1.92T$ with a thickness of 0.30 mm.

Table 1

| Heat No. | | Slab | Scale-breaker $R_1$ | Pass schedule of rough rolling $R_2$ | $R_3$ | $R_4$ | $R_5$ | $R_6$ | $R_7$ | Degree of edge cracks (one side) |
|---|---|---|---|---|---|---|---|---|---|---|
| A | Thickness mm | 250 | 240 | 170 | 120 | 100 | 80 | 53 | 30 | 5–200 mm |
| | Reduction rate % | — | 4.0 | 29.2 | 29.4 | 16.7 | 20.0 | 33.8 | 43.4 | |
| B | Thickness mm | 250 | 240 | 180 | 140 | 120 | 65 | 31 | 30 | 5–60 mm |
| | Reduction rate % | — | 4.0 | 25.0 | 22.2 | 14.3 | 45.8 | 52.3 | 3.2 | |
| C | Thickness mm | 250 | 240 | 180 | 130 | 80 | 50 | 40 | 30 | ≦10 mm |
| | Reduction rate % | — | 4.0 | 25.0 | 27.8 | 38.5 | 37.5 | 20.0 | 25.0 | |
| D | Thickness mm | 250 | 240 | 160 | 90 | 33 | 30 | — | — | ≦10 mm |
| | Reduction rate % | — | 4.0 | 33.3 | 43.8 | 63.3 | 9.1 | — | — | |
| E | Thickness mm | 250 | 240 | 170 | 105 | 55 | 30 | — | — | 10–230 mm |
| | Reduction rate % | — | 4.0 | 29.2 | 38.2 | 47.6 | 45.5 | — | — | |

EXAMPLE 2

Hot coils were produced, adapting the same pass schedule as Heat D shown in Table 1 and at the same time, changing the set condition of an edger respectively. The results are shown in Table 2.

Table 2

| Heat No. | Setting width of edger (mm) | (Slab width)-(Hot coil width) (mm) | Degree of edge cracks (one side) | An amount of width fluctuation of hot coil (mm) |
|---|---|---|---|---|
| D | 990 | +20 | <10 mm | 10 |
| D-1 | 1,010 | ±0 | <5 mm | 11 |
| D-2 | 1,030 | −20 | <5 mm | 11 |
| D-3 | 1,050 | −40 | <5 mm | 12 |
| D-4 | 1,060 | −50 | <5 mm | 17 |
| D-5 | 1,070 | −60 | <5 mm | 30 |

As understood from Table 2, the edge crack is further decreased when the reduction rate of the edger is small as in the case of Heat D-1 to Heat D-5 as compared with Heat D. However, when the width of the edger is excessive as in Heat D-4 and Heat D-5, the amount of fluctuation in the hot coil width becomes large which causes the edge crack, thus offsetting the advantageous effect of the edger. Therefore, the set condition of the edger in Heat D-3 is the upper limit in these examples. As understood from Table 1, in Heat C and Heat D, the reduction rates of the last pass in the rough rolling were adjusted to 25% and 9.1% respectively. The edge cracks in the resultant products were as low as less than 10 mm. On the contrary, in case of Heat A, Heat B and Heat E, the reduction rates were 43.4%, 3.2% and 45.5% respectively, and the abnormal edge crack occurred everywhere.

What is claimed is:

1. In a method for producing a grain oriented silicon steel sheet having an excellent uniform shaped edge from a continuously cast steel slab, which comprises: heating a continuously cast steel slab containing 2.5 to 4.0% silicon to a temperature between 1280° C. and 1430° C., hot rolling the heated slab at a starting temperature not lower than 1050° C. in a finish hot rolling step, continuously annealing the hot rolled sheet, cold rolling the annealed sheet and finally annealing the cold rolled sheet at a high temperature for secondary recrystallization, the improvement which comprises subjecting the slab to a series of rough hot rolling passes prior to the hot finishing step such that the reduction rate in the last half stage of the rough hot rolling is 5 to 35% so as to prevent edge cracks in a hot coil thus-produced from the method; said rough rolling being performed at a temperature not less than 1050° C.

2. The improvement according to claim 1, in which the last half stage comprises the last one or two passes in the rough hot rolling.

3. The improvement according to claim 1, in which the rough hot rolling is done by an edger with a distance between edger rolls being such that the width of the hot rolled sheet is larger than that of the slab but the width variation of the resultant hot coil is controlled.

* * * * *